US010235978B2

(12) United States Patent
Bean et al.

(10) Patent No.: US 10,235,978 B2
(45) Date of Patent: Mar. 19, 2019

(54) DUAL VOLUME PERCUSSION INSTRUMENT SYSTEM

(71) Applicants: Michael H Bean, Milwaukee, WI (US); Abigail E Bean, Milwaukee, WI (US)

(72) Inventors: Michael H Bean, Milwaukee, WI (US); Abigail E Bean, Milwaukee, WI (US)

( * ) Notice: Subject to any disclaimer, the term of this patent is extended or adjusted under 35 U.S.C. 154(b) by 0 days.

(21) Appl. No.: 15/705,186

(22) Filed: Sep. 14, 2017

(65) Prior Publication Data

US 2018/0082667 A1 Mar. 22, 2018

Related U.S. Application Data

(60) Provisional application No. 62/396,096, filed on Sep. 16, 2016.

(51) Int. Cl.
*G10D 13/02* (2006.01)
*G10G 1/04* (2006.01)

(52) U.S. Cl.
CPC ..... *G10D 13/022* (2013.01); *G10D 13/025* (2013.01); *G10D 13/027* (2013.01); *G10D 13/029* (2013.01); *G10G 1/04* (2013.01)

(58) Field of Classification Search
CPC .... G10D 13/025; G10D 13/022; G10D 13/02; G10D 13/028
See application file for complete search history.

(56) References Cited

U.S. PATENT DOCUMENTS 729,936 A * 6/1903 Heybeck ..... G10D 13/027 84/414
859,036 A * 7/1907 Baggs ..... G10D 13/028 84/412
1,615,202 A * 1/1927 Hagen ..... G10D 13/02 84/411 R
2,604,001 A * 7/1952 Lewan ..... G10D 13/025 84/417
2,858,724 A * 11/1958 Troppe ..... G10D 13/02 84/411 R
3,635,119 A * 1/1972 Thompson ..... G10D 13/02 84/411 M
3,911,779 A * 10/1975 Della-Porta ..... G10D 13/02 84/411 R
4,168,064 A * 9/1979 Petrovic ..... A63B 60/40 473/466
4,214,504 A * 7/1980 Rex ..... G10D 13/02 84/411 R
4,993,304 A * 2/1991 Lovelet ..... G10D 13/028 84/411 R
5,377,576 A * 1/1995 Good ..... G10D 13/028 84/411 R (Continued)

*Primary Examiner* — Robert W Horn

(57) ABSTRACT

The present invention comprises a drum with two playing surfaces on opposites ends of a hollow drum body. The drum is configured for the first drum head to produce a loud sound and the second head to produce a quiet sound, under the same full force drum strikes without compromising the feel and rebound of the drum heads. The drum may have a central base, a shell disposed on each side of the base, and a drum head stretched over each of the shell. The drum heads are attached to a shallow drum body with independent tensioning of the heads and sandwiched drum shells. The tensioning system is mounted to the central base. An optional snare system may be mounted to the base.

19 Claims, 10 Drawing Sheets

(56) References Cited

U.S. PATENT DOCUMENTS

| | | | | |
|---|---|---|---|---|
| 6,069,307 | A * | 5/2000 | Rogers | G10D 13/023 84/411 R |
| 6,417,432 | B1 * | 7/2002 | Downing | G10D 13/023 84/411 A |
| 6,441,287 | B1 * | 8/2002 | Crouch | G10D 13/025 84/415 |
| 6,462,262 | B2 * | 10/2002 | Hagiwara | G10D 13/02 84/411 R |
| 7,498,500 | B2 * | 3/2009 | Rogers | G10D 13/029 84/411 M |
| 7,514,617 | B2 * | 4/2009 | Rogers | G10D 13/029 84/411 A |
| 7,718,876 | B1 * | 5/2010 | Good | G10D 13/028 428/106 |
| 7,781,661 | B2 * | 8/2010 | Rogers | G10D 13/029 84/411 R |
| 7,888,574 | B1 * | 2/2011 | Acoutin | G10D 13/028 84/411 R |
| 8,253,001 | B1 * | 8/2012 | Liu | G10D 13/02 84/411 R |
| 8,686,264 | B2 * | 4/2014 | Morita | G10H 1/32 84/413 |
| 8,835,733 | B2 * | 9/2014 | Boulet | G10D 13/02 84/411 R |
| 8,933,310 | B2 * | 1/2015 | Rogers | G10D 13/02 84/104 |
| 9,466,273 | B2 * | 10/2016 | Krol | G10D 13/025 |
| 9,704,460 | B2 * | 7/2017 | Hacker | G10D 13/025 |
| 2017/0154613 | A1 * | 6/2017 | Broadbelt | G10D 13/02 |
| 2018/0082667 | A1 * | 3/2018 | Bean | G10D 13/022 |
| 2018/0137843 | A1 * | 5/2018 | Roderick | G10D 13/022 |

* cited by examiner

DUAL VOLUME PERCUSSION INSTRUMENT SYSTEM

BACKGROUND

A drum is a musical instrument that is intended to produce loud sounds. This noise level provides drawbacks for the drummer who wishes to play at lower volume; for example, when practicing around other people or in a residence. The drummer may also wish to practice technique and feel by using stage quality drum sticks with full force drum strikes. Further, it may be desired to have both a loud, performance volume playing mode and a quiet, unobtrusive, practice volume playing mode on a single instrument. Currently available solutions for reducing drum strike volume do not satisfactorily achieve these goals.

What is needed is a percussion instrument system that allows the drummer to produce a loud, performance level volume and an unobtrusive, quiet, practice level volume without compromising the physical feel and rebound of the drum heads and without adding, removing, or changing any hardware.

SUMMARY OF INVENTION

Briefly described, in one aspect the present invention comprises a drum having a drum body having a first edge and a second edge at opposite ends of the drum body. A first drum head is disposed against the first edge and a second drum head is disposed against the second edge. The first drum head has high air resistance and the second drum head has low air resistance.

In another aspect, the present invention comprises a drum having a drum body having a first edge and a second edge at opposite ends of the drum body. A first drum head is disposed against the first edge and second drum head is disposed against the second edge. The drum is configured to make a loud sound when the first drum head is struck by a drumming instrument and to make a quiet sound when the second drum head is struck by the drumming instrument.

In another aspect, the present invention comprises a drum having a base having a first mount surface and an opposed second mount surface. A first shell is disposed on the first mount surface and a first drum head is disposed over the first shell. A second shell is disposed on the second mount surface and a second drum head is disposed over the second shell. A tensioning system connects the base to the first drum head and the second drum head. The tensioning system places the first drum head under a first tension and the second drum head under a second tension.

In another aspect, the present invention comprises a drum having a base having a mount surface and a shell disposed on the mount surface. A drum head is disposed over the shell. One or more snare wires are secured to the base such that a portion of the snare wires are disposed against an underneath surface of the drum head.

In another aspect, the present invention is a method for using a drum. A drum is obtained that comprises a base having a first and second mount surface, a first shell disposed on the first mount surface, a first drum head disposed over the first shell, a second shell disposed on the second mount surface, a second drum head disposed over the second shell, and a tensioning system connecting the base to the first drum head and connecting the base to the second drum head, the tensioning system being configured to place the first drum head under a first tension and place the second drum head under a second tension. The first drum head is tensioned to a first tension. The second drum head is tensioned to a second tension.

In another aspect, the present invention is a method for using a drum. A drum is obtained that comprises a drum body, a first drum head disposed on a first end of the drum body, and a second head disposed on a second end of the drum body; such that the drum is configured to make a loud sound when the first drum head is struck by a drumming instrument and to make a quiet sound when the second drum head is struck by the drumming instrument. The drum is secured into a holder so that the first drum head is oriented into a playing position. The first drum head is struck with a drumming instrument to produce a loud sound. The drum is removed from the holder. The drum is secured into the holder in an inverted position so that the second drum head is oriented into a playing position. The second drum head is struck with the drumming instrument to produce a quiet sound.

In another aspect, the present invention is a method for assembling a drum. A base having a first mount surface and second mount surface is obtained. A first shell is positioned on the first mount surface. A first drum head is positioned over the first shell. A second shell is positioned on the second mount surface. A second drum head is positioned over the second shell. The first drum head and the second drum head are secured to the base with a tensioning system. The tensioning system is adjusted to tune the first drum head and the second drum head.

In another aspect, the present invention is a method for assembling a drum. A base having a mount surface is obtained. A shell is positioned on the mount surface. A drum head is positioned over the shell. The drum head is secured to the base with a tensioning system. A snare wire is obtained having a first end, a second end, and a midsection between the first end and the second end. The snare wire is secured to the base such that the first end and the second end are secured to the base and the midsection is disposed against an underneath surface of the drum head.

These and other features, aspects, and advantages of the present invention will become better understood with references to the following description and claims

BRIEF DESCRIPTION OF FIGURES

Objects, features, and advantages of embodiments disclosed herein may be better understood by referring to the following description in conjunction with the accompanying drawings. The drawings are not meant to limit the scope of the claims included herewith. For clarity, not every element may be labeled in every figure. The drawings are not necessarily to scale, emphasis instead being placed upon illustrating embodiments, principles, and concepts. Thus, features and advantages of the present disclosure will become more apparent from the following detailed description of exemplary embodiments thereof taken in conjunction with the accompanying drawings.

DETAILED DESCRIPTION

Figure 1:
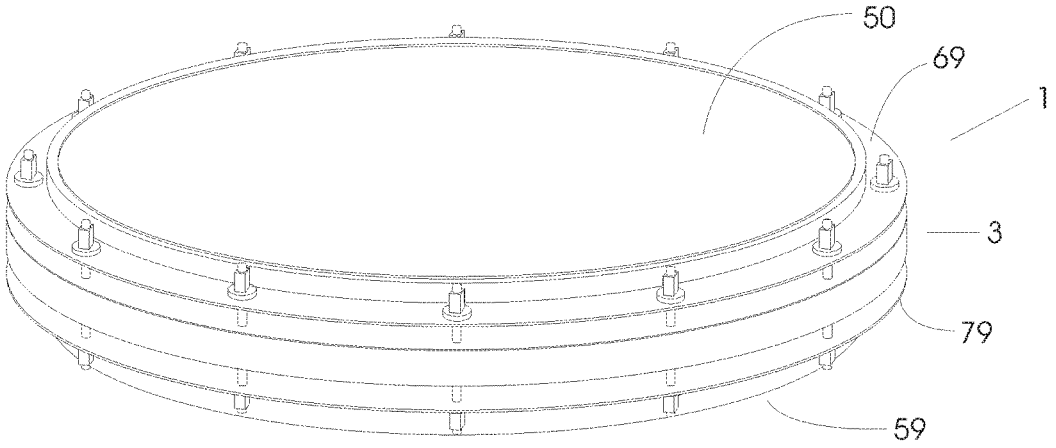
FIG. 1 is an isometric view of a drum according to an exemplary embodiment of the present disclosure.

Referring now to the drawing figures, wherein like reference numerals represent like parts throughout the several views, FIGS. 1-4 shows one exemplary form of the drum of the current invention. A drum 1 comprises a first drum head 50, a second drum head 59, a drum body 3, and a tensioning system 4. The body 3 comprises a base 11, a first shell 29, and a second shell 36.

The base 11 is constructed of a material that is rigid enough to resist warping under the forces related to the tensioning of the drum heads 50, 59. The base 11 may be made of wood. The base 11 may have a thickness within the range of ⅜ inch to ¾ inch. Preferably, the base 11 has a thickness of 7⁄16 inch for tom-tom style drums and 11⁄16 inch for other style drums. The base 11 may be made of fiberglass, rigid polymer, or other suitable material. The base 11 may be constructed of solid wood. The base 11 may be made of multiple plies of wood laid up to produce the full thickness.

The base 11 is constructed of a material that is rigid enough to resist warping under the forces related to the tensioning of the drum heads 50, 59. The base 11 may be made of wood. The base 11 may have a thickness within the range of ⅜ inch to ¾ inch. Preferably, the base 11 has a thickness of 7⁄16 inch. The base 11 may be made of fiberglass, rigid polymer, or other suitable material. The base 11 may be constructed of solid wood. The base 11 may be made of multiple plies of wood laid up to produce the full thickness.

The base 11 has a plurality of tension system holes 14 that extend through the thickness of the base; e.g. from the first mount surface 12 to the second mount surface 13. The holes 14 are preferably arranged in a circular pattern and are equally spaced circumferentially. The holes 14 are parallel with the drum axis 2.

The first drum shell 29 is disposed on the first mount surface 12 and the second drum shell 36 is disposed upon the second mount surface 13. Each of the first drum shell 29 and second drum shell 36 is an annular ring with a thin cylindrical wall with an inner surface, an outer surface, a first edge, and a second edge. The first edge and second edge are parallel, or nearly parallel to each other, and perpendicular to, or nearly perpendicular to, the shell wall. The first shell 29 is disposed on the base 11 with the first shell first edge 32 placed on the first mount surface 12 and the first shell 29 located coaxial with the drum axis 2. The first shell 29 is positioned between the inner bore 16 and the ring of tension system holes 14. The second shell 36 is disposed on the base 11 with the second shell first edge 40 placed on the second mount surface 13 and the second shell 36 located coaxial with the drum axis 2. The second edge of the first shell 33 establishes a first end of the drum body 6 and the second edge of the second shell 41 establishes a second end of the drum body 7. The inner surfaces of the first shell 30 and second shell 38 and the inner bore of the base 16 establish a hollow chamber 43 inside the drum. The length 8 of the drum is the distance from the first end of the drum body 6 to the second end of the drum body 7.

The length of the first drum shell 35 and the length of the second drum shell 37 are depicted in FIG. 1-4 as significantly the same length. Drums come in varying lengths. A conventional drum shell may be nearly any length; however a drum shell length is rarely less than 3 inches in length. The drum shells 29, 36 may be formed of rigid materials such as, for example, wood, plastic, fiberglass, aluminum, other metals, or other suitable materials. A typical wooden shell may have a thickness in the range of 3⁄16 inch to ½ inch. A typical metal shell may have a thickness in the range of 1⁄32 inch to ¼ inch. The diameter of the shell, in general, establishes the diameter of the drum. Typically, drum shells may be made in diameters as small as 6 inches and as large as 40 inches. The first drum shell 29 and second drum shell 36 may have dissimilar shell lengths.

A first drum head 50 is placed over the first end of the drum body 6, and a second drum head 59 is placed over the second end of the drum body 7. The first drum head 50 and the second drum head 59 each have a central circular membrane section 51, 62, a peripheral circular edge 53, 64, and an angled collar section 52, 63 between the membrane 51, 62 and the peripheral edge 53, 64. Each drum head has a top surface 56, 67 and an underneath surface 57, 68. Along the peripheral edge 53, 64 is a bead 54, 65. The bead 54, 65 is a circumferential ring made of a strong, resilient material, for example aluminum or other metal. The bead 54, 65 gives a stiff, continuous top edge to engage the tensioning system 4.

The tensioning system 4 secures the drum heads 50, 59 to the drum body 3, places the drum heads 50, 59 under tension, and secures the drum shells 29, 36 to the base 11. The tensioning system 4 comprises tension rods 88 secured to the base 11, a first hoop 69, a second hoop 79, and a set of lugs 100, 103. A plurality of rods 88 extends through the plurality of tension system holes 14 on the base 11. Each rod 88 has a first end 90 and a second end 91. A first securing lug 103 is advanced from the first end of the rod 90 (or each rod) and a second securing lug 103 is advanced from the second end of the rod 91 (or each rod). The securing lugs 103 are advanced until they contact the first mount surface 12 and second mount surface 13. The lugs 103 secure the rod 88 to the base 11 so that the first end the rod 90 extends outward, axially (parallel to the drum axis) from the first mount surface 12 and the second end of the rod 91 extends outward, axially from the second mount surface 13. The first end of the rod 90 and the second end of the rod 91 have external screw threads. Alternatively, the rod 88 may have an external thread that extends the full length of the rod 88.

A first hoop 69 is disposed upon the first drum head 50 and engages the first plurality of tension rods 88. The hoop 69 has an annular ring body 70. The ring body 70 has a bottom edge 75. The bottom edge 75 has a circular contact surface 76 that is brought into contact with the top edge of the bead 54. The hoop has a flange 71 extending radially outward from the ring body 70. The flange 71 has a plurality of holes 74. The holes 74 fit around the plurality of tension rods 88. A tensioning lug 100 is advanced from the end of the rod 90 and brought into contact with the flange 71.

Preferably, a tensioning lug 100 is advanced onto each of the tension rods 88. In this way, the hoop 69 can be brought into contact with the drum head 50 at multiple points to provide a tension force that is applied evenly along the periphery of the drum head. As the tensioning lugs 100 are advanced along the rod 88, the first hoop 69 is advanced against the first drum head 50. The first drum head 50 is stretched over the first shell 29 and the first shell 29 is brought into compressive contact with the first mount surface 12. Drum head tension is established in the first drum head 50.

Rods 88, securing lugs 103, and tensioning lugs 100 may be constructed of any material strong enough to support a tension load and a thread. Preferably the rods 88 and lugs are metal such as steel. The threads may be any thread, but are preferably a common thread such as an #8-32 thread. The securing lugs 103 and tensioning lugs 100 have an external body with an outer shape that may be square, hexagonal, or any other shape that is suitable to be grasped by a wrench or other tensioning instrument (not shown). The securing lugs 103 and tensioning lugs 100 have internal screw threads that match the external threads on the rods 88.

The second hoop 79 has significantly the same construction as the first hoop 69. The second hoop 79 has a ring body 83, an outwardly extending flange 86 with holes 82 and circular contact surface 80. The second hoop 79 is positioned in contact with the top edge of the bead 65 on the second drum head 59. The second hoop 79 engages the plurality of tension rod 88 that extends outward from the second mount surface 13. A tensioning lug 100 is advanced from the second end of each of the rods 91 to capture the flange 86 of the second hoop 79. As the tensioning lugs 100 are advanced along the rod 88, the second hoop 79 is advanced against the second drum head 59. The second drum head 59 is stretched over the second shell 36. The second shell 36 is brought into compressive contact the second mount surface 13. Drum head tension is established in the second drum head 59.

The tension system 4 is configured to draw the first drum head 50 over the first shell 29 towards the base 11 and draw the second drum head 59 over the second drum shell 36 towards the base 11. The tensioning system 4 may be used to alter the tension within, or, tune, the drum heads 50, 59. The drum head tension is increased by advancing the tensioning lugs 100 towards the base 11 and the drum head tension is reduced by retracting the tensioning lugs 100 away from the base 11. The first drum head 50 and second head 59 can be tensioned, or tuned, independently.

Optionally there may be one or more anti-backlash features to hold the securing lugs 103 or tensioning lugs 100 in place. Anti-backlash features are generally used to resist reverse movement of a threaded fasteners in a mechanical system in vibratory environments, such as drums. One example of an anti-backlash feature is a washer. A washer 104 may be placed between one of the mount surfaces 12, 13 and a securing lug 103 or between one of the hoops 69, 79 and a tensioning lug 100. The washer 104 may be a flat washer, a split washer, a wave washer, or a star washer. The lugs 100, 103 may have a pliable interference features, such as a polymer lock nut. The rods 88 may be coated with a pliable anti-backlash coating.

Figure 5:
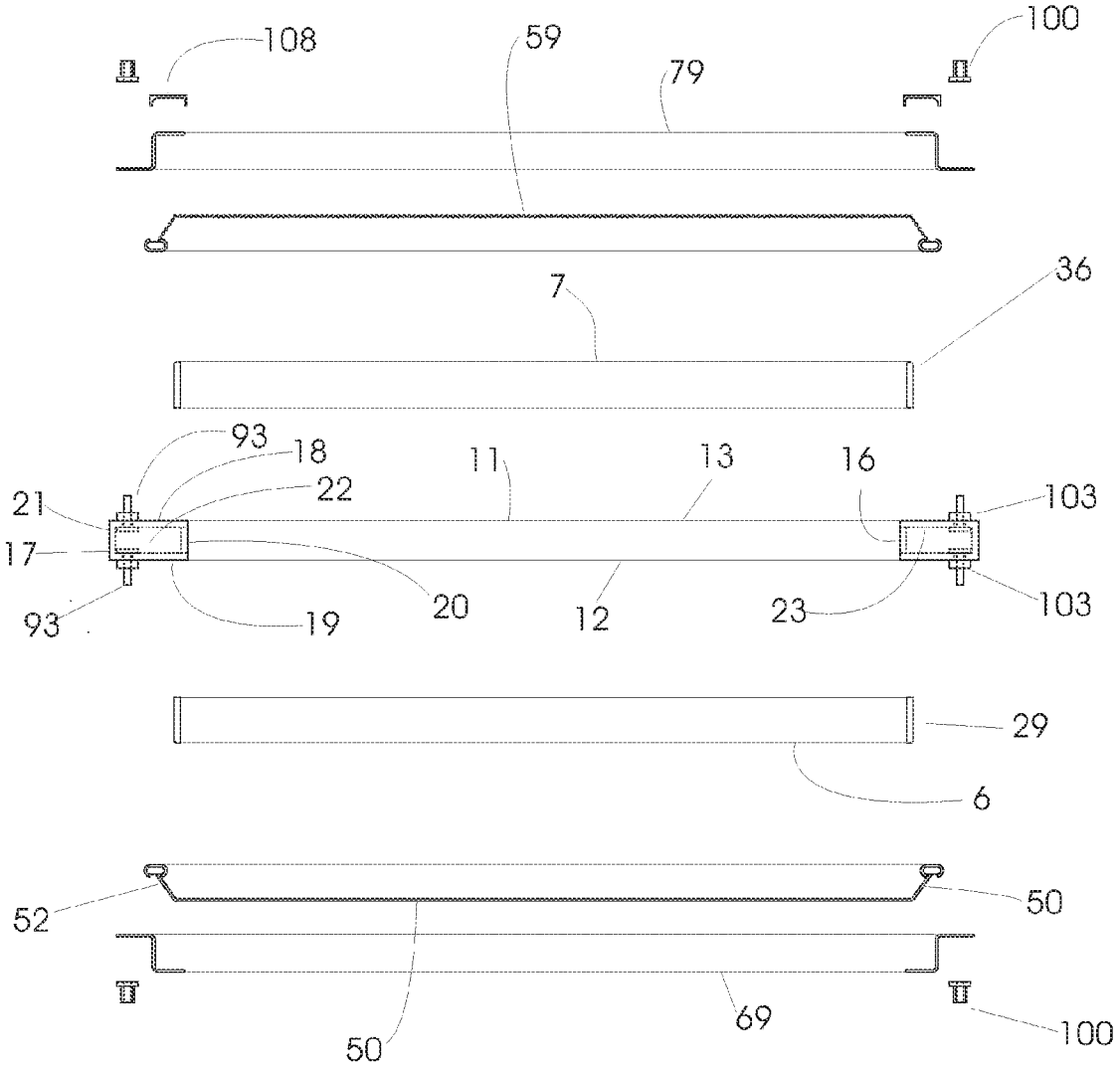
FIG. 5 is an exploded cross-section side view of a drum according to an exemplary embodiment of the present disclosure.

FIG. 5 shows another exemplary embodiment of the present inventions having an alternative structure for connecting the base 11 to the tensioning system 4. The base 11 comprises a top plate 18, a bottom plate 19, an inner ring 20, and an outer ring 21. The plates 18, 19 and the rings 20, 21 may be assembled to form an annular ring 11 with a hollow cross-section 22. The plates 18, 19 and rings 20, 21 may be wooden. The hollow construction may be fabricated from smaller and lighter components than a solid base without compromising strength or rigidity.

Figure 7:
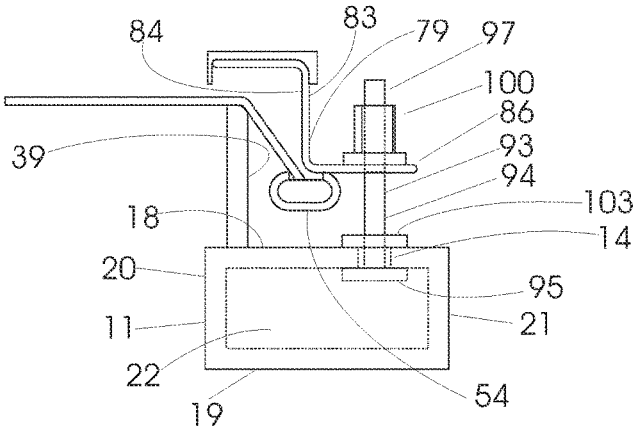
FIG. 7 cross-section side view of an exemplary embodiment of the tensioning system.

FIGS. 5 and 7 show a first post 93 (representing a plurality of first posts) secured to the base 11 and extending outward, axially from the first mount surface 12. A second post 93 (representing a plurality of second posts) is secured to the base 11 and extends outwardly, axially from the second mount surface 13. Each post 93 has a post body 94, a post head 95, and a free end 97. The post body 94 is a cylindrical shaft. The post head 95 is a broadened portion at one end of the post 93. The free end 97 has a screw threads, preferably a standard machine screw head such as #8-32. The free end of the threaded post 97 is passed through the tension system hole 14. The tension system hole 14 is sized to allow the post body 94 to pass through but is too small to allow the head 95 to pass through. A securing lug 103 is advanced on the free end of post 97 and tightened to the base 11 so that a portion of the base is captured between the lug 103 and the undersurface of the post head 95. In this way, the tension posts 93 are secured to the base 11. In FIG. 5 the underneath surface of the head 95 is shown mated against the bottom surface of the top beam 23, but the underneath surface of the head 95 can be secured to the underside of the base, for example, the second mount surface 13 for a post 93 that extends upward from the first mount surface 12, or to a counterbore (not shown). A plurality of posts 93 are secured to the base 11 to extend outward, axially from the second mount surface 13. With the posts 93 secured to the base 11 and extending outwardly from the first mount surface 12 and the second mount surface 13, the assembly of the rest of the drum progresses as described in FIGS. 1-4.

The inside surface of ring body 84 is larger than the shell outer diameter 31 so that there is no direct contact between the shell 36 and the hoop 79. The tensioning system 4 has no hardware (e.g. lugs or posts) that is physically mounted to the shell 36 that might interfere with the free vibration of the shell 36; and therefore the sound quality of the drum 1 is not compromised. The shells are, thus, referred to as sandwiched shells.

In one aspect, therefore, the present invention provides for a drum 1 with a drum body 3, sandwiched shells 29, 36, a first drum head 50 secured to one end of the drum body 6, a second drum head 59 secured to a second end of the drum body 7, and a tensioning system 4 that allows for the first drum head 50 and that the second drum head 59 to be tensioned independently. The tensioning system 4 secures the first drum shell 29 by placing it under a compressive load between the first drum head 50 and the base 11, and likewise secures the second shell 36 by placing it under a compressive load between the second drum head 59 and the base 11. The shells 29, 36 are secured to the base 11 in the absence of adhesives, clamps, or securing hardware.

A drum of this configuration may include a first drum head 50 and a second drum head 59 of identical construction. Alternatively, a drum of this configuration may have a first drum head 50 and second drum head 59 of different construction.

One type of drum head is referred to here as a standard drum head 58. Standard drum heads are generally composed of animal skin or a plastic material, for example, polyvinylchloride or polyurethane terephthalate, etc. These materials can vary in thickness but are approximately 0.010" thick. Standard drum heads may be fabricated from multiple plies. They may be enhanced with coatings or contain oil sandwiched between the layers of the materials to increase mass or stiffness. A standard drum head may be referred to as a batter head, or a batter drum head.

Another type of drum head is referred to here as a mesh head, or mesh drum head. Mesh heads 60 are made of a woven or non-woven fabric. The fabric may be made of plant fibers, carbon fibers, fiber glass, or any suitably strong fiber. The key aspect of a mesh head is that it does not block all the air flow through the membrane; it is a permeable head. The weight or density of a mesh head 60 may be less than a standard drum head 58.

Drum heads can be constructed to have a high air resistance. Air resistance is the amount of drag force that the drum head imparts on the air in the immediate vicinity of the drum head (proximate air) when the drum head and the proximate air move relative to each other. A drum head with high air resistance imparts a high drag force on the air. A drum head with high air resistance couples with the air to a significant amount and the movement of the drum head causes significant concomitant movement of the air. The creation of concomitant air movement is referred to as air linkage. A drum head with high air resistance has high air linkage. At a common extreme, a drum head with high air resistance may be impermeable to air flow. An impermeable drum head blocks all air flow through the membrane of the drum head. A standard drum head is an example of an impermeable drum head.

An impermeable drum head might have holes or slots of considerable size cut into the membrane section of the drum head; and these holes may allow air to pass from one side of the drum head to the other. However, the bulk material is impermeable to air flow and in the absence of these holes or slots the drum head would not allow the passage of air through the membrane section of the drum head.

Drum heads can be constructed to have a low air resistance. A drum head with low air resistance imparts a low drag force on the air. The drum head does not couple with the air to a significant amount and the movement of the drum head does not cause significant concomitant movement of the air; e.g. low air linkage. The drum head may pass relatively easily through the air, or the air may move relatively easily through the drum head. This type of drum head may be referred to as permeable head. Air flow through a permeable drum head is resisted, to some extent, but it is not fully blocked. A mesh head is an example of a permeable drum head.

In one conventional drum configuration, a standard drum head 58 is secured to one end of a hollow drum body 6 and the second end of the drum body 7 is left open. There is no drum head attached to the second end of the drum body 7. Sometimes the drum head attached to the first end of the drum body 6 is a mesh head to produce a quieter drumming instrument. In this configuration, mesh heads 60 are known to produce more bounce than a batter head 58, or "over springiness." The excess springiness may be detrimental because the mesh head 60 does not provide the same rebound or feel of a batter head 58.

In a second conventional drum configuration, a batter head 58 is secured to one end of a hollow drum body 6 and a different type of impermeable drum head called a resonant head is applied to the second end of the drum body 7. A resonant head is a drum head fabricated of a thinner and lighter material than a standard drum head. The batter head is placed in the playing position of the drum and the resonant head is used to provide a second head to improve the sound quality of the batter head. The resonant head is not intended to be struck or played. Although not struck directly, the resonant head vibrates. Vibrations produced in the batter head are transferred through the drum to the resonant head and excite sympathetic vibrations in the resonant head. A sympathetic vibration is a vibration that is produced by a drum head because of energy transferred from another drum head rather than being directly struck by a drumming instrument. Because the resonant head is made of a different material than the batter head it may be beneficial to be able to tension the resonant head and the batter head independently.

In one aspect, and directed at providing a drum with dual volume support, the present invention presents another drum configuration. The drum 1 has a first drum head 50 having a high air resistance secured to one end of a hollow drum body 6 and a second drum head 59 with a low air resistance secured to the second end of the drum body 7. The drum 1 may have a first drum head 50 that is impermeable and a second drum head 59 that is permeable. This drum may have a standard drum head, or batter head 58, at the first end of a hollow drum body 6 and a mesh head 60 at the second end of the drum body 7. This drum is configured to play a loud, performance volume sound on the first drum head 50 and an unobtrusive, quiet, practice volume sound on the second drum head 59. Adjusting the tension placed on drum heads will affect the timbre, pitch, and amplitude of the sound waves emitted from the instrument; as well as the feel of the rebound of the drumming instrument. So, it may be beneficial to be able to tension the batter head 58 and the mesh head 60 independently.

The drum 1 may have an optional rim guard 108. Hoop 79 has a top rim 87 that extends radially inward from the ring body 83 upon which is installed a rim guard 108. The rim guard 108 is made of an energy absorbing material such as rubber or compliant plastic. The rim guard 108 aids in reducing sound of rim-shots. A rim shot is a strike to the rim or hoop of the drum 79 by a drumming instrument 110. A rim guard 108 may be placed on either or both hoops 69, 79. Preferably, a rim guard 108 may be placed on the second hoop 79 near the mesh head 60 and the rim 77 next to the first hoop 69 is left bare. In this way, any rim shots to the rim next to the reduced volume drum head have reduced volume, while any rim shots on the rim next to the full volume drum head have full volume.

Figure 6:
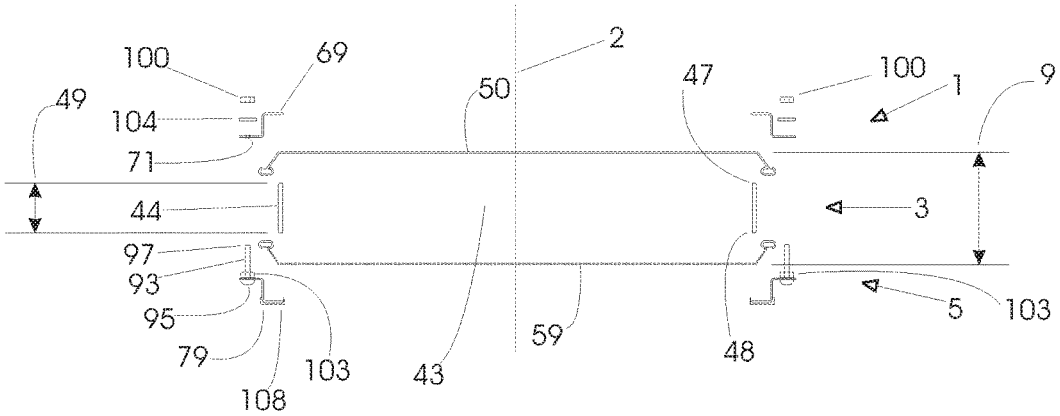
FIG. 6 is an exploded cross-section side view of a drum according to an exemplary embodiment of the present disclosure.

FIG. 6 shows another exemplary form of the current invention. The drum 1 comprises a first drum head 50, a second drum head 59, a drum body 3, and a tensioning system 5. The drum body 3 comprises a single shell 44. The shell 44 has a first edge 47 and a second edge 48. The shell 44 is similar in construction to either of the first shell 29 or second shell 36 shown in FIGS. 1-4. A first drum head 50 is placed over the first edge, or end, of the shell 47. A first hoop 69 is placed over the first drum head 50 so that the bottom edge 75 captures the bead of the first drum head 50. A second drum head 59 is placed over the second edge, or end, of the shell 48. A second hoop 79 is placed over the second drum head 59 so that the bottom edge 85 captures the bead of the second drum head 59. A plurality of tension rods 88 is passed through holes 82 in the second hoop 79. A securing lug 103 is advanced on the free end of each of the rods 97 to capture the flange 86 of the second hoop 79 between the securing lug 103 and the head of the tension post 95. The free ends of the posts 97 are passed through holes 74 on the first hoop 69. A tensioning lug 100 is advanced from the free end of each rod 97. The tensioning lugs 100 are tightened on the rods 88 to draw the two hoops 69, 79 towards each other. As the hoops 69, 79 advance towards each other they draw the drum heads 50, 59 down over the shell 44 and tension the drum heads 50, 59. The tensioning system 5 may be used to alter the tension across the drum heads 50, 59. The drum head tension is increased by advancing the tensioning lug 100 on the rod 93, and drum head tension is reduced by retracting the tensioning lugs 93. The first drum head 50 and second head 59 can be tensioned, or tuned, jointly.

The first drum head 50 is a drum head with high air resistance and the second drum head 59 is a drum head with low air resistance. Specifically, the first drum head 50 may be standard drum head (batter head) 58 and the second drum head 59 may be a mesh head 60. In this embodiment, the tensioning system 5 does not support independently tensionable drum heads however the design is simplified and has a reduction in part count and presumably cost.

FIGS. 8-13 demonstrate how the exemplary drum 1 behaves when struck by a drumming instrument 110 such as drum stick. The exemplary drum 1 is configured to produce a loud drum sound when the first drum head 50 is struck and a quiet drum sound when the second drum head 59 is struck. The first drum head 50 is a typical batter drum head 58. The first drum head 50 is an impermeable head and has a high air linkage. The first drum head 50 may be referred to as the "performance head". The second drum 59 is a typical mesh drum head 60 and has a low air linkage. It is permeable to air flow. The second drum head 59 may be referred to as the "practice head".

The drum 1 may be placed in one orientation to be played in a loud mode and inverted and placed in a second orientation to play in a unobtrusive mode. To utilize the drum in performance (loud) mode the drum may be placed and secured in a holder (not shown) with the performance head placed in the playing position.

Figure 8:
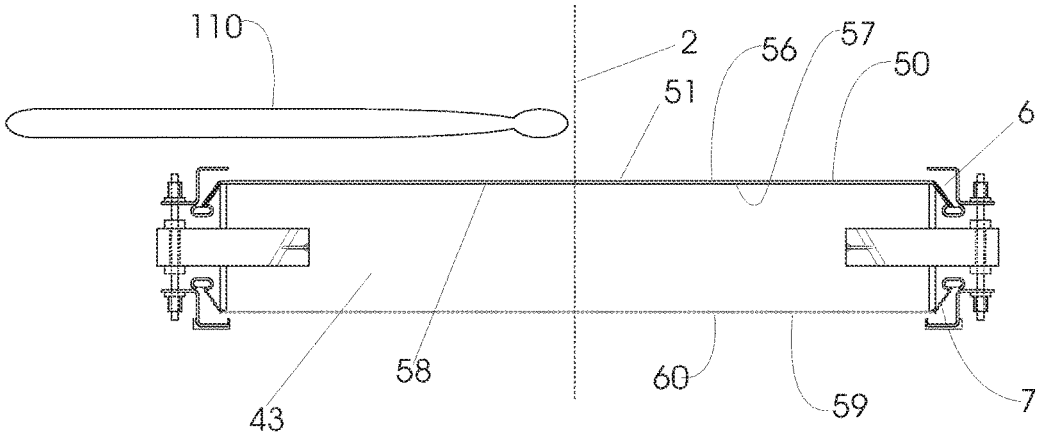
FIGS. 8-13 are cross-section side views of a drum according to an exemplary embodiment of the present disclosure depicting the response to the striking of the drum by a drumming instrument.
Figure 9:
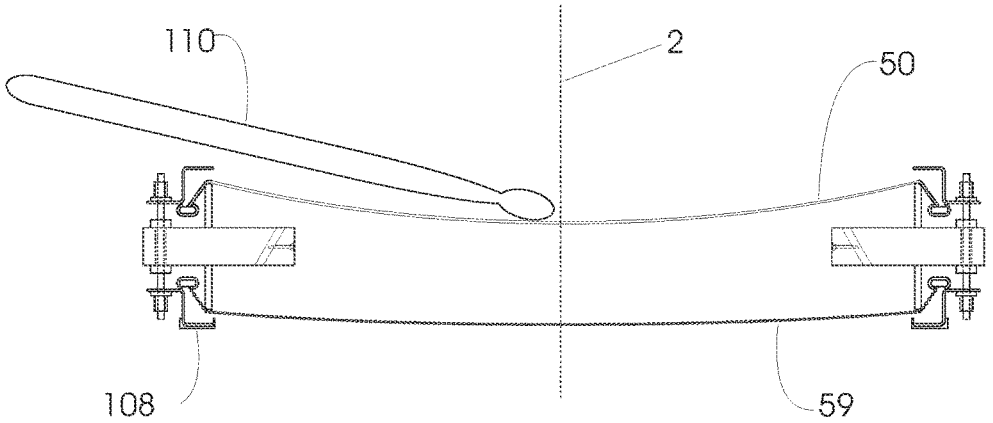
Figure 10:
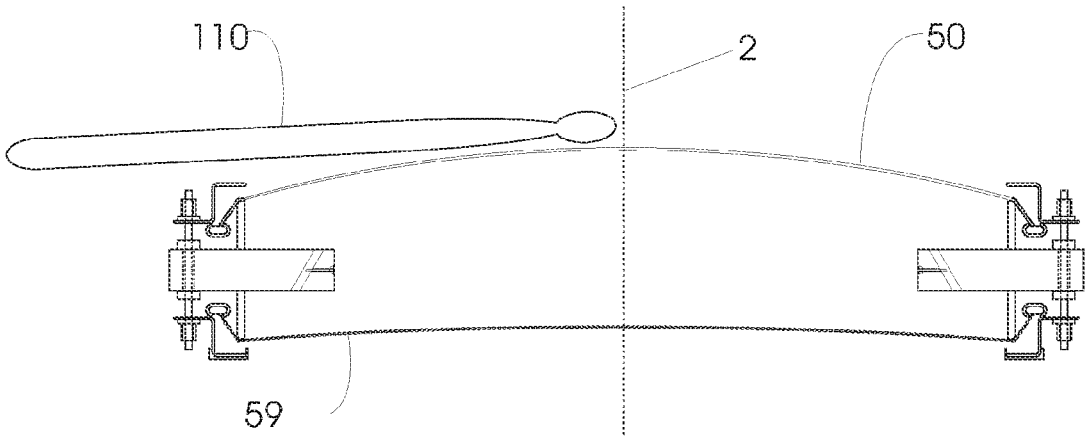

FIGS. 8-10 show the response of the drum 1 when it is struck on the performance head 58 by a drumming instrument 110, such as a drum stick. When a drum with two heads is struck on one head, energy is transferred between the two heads until all energy is dissipated and the drum returns to the equilibrium state. The transfer of energy through the air in the inside of the drum is called air transfer and the transfer of energy through the solid components of the drum (shells, base, tension rods, etc.) is called mechanical transfer.

Referring to FIG. 8, prior to the drum strike the batter head 58 and the mesh head 60 are at rest and air above the drum, below the drum, and within the drum is at equilibrium. In this configuration, the batter head 58 is on top in the playing position and the mesh head 60 is on the bottom of the drum. The terms, "above", "top", "upward", "below", "downward" are meant to indicate the orientation of a drum in a conventional playing position in which the struck head is horizontal and facing upward relative to the ground. However, the drum 1 may be placed in a variety of orientations whether horizontal, vertical, inverted, or anywhere in between. These directional terms are meant to be used in the relation to the direction from which the playing head faces.

Referring to FIG. 9, when the batter drum head 58 is stuck, it displaces downwardly. Because the batter head 58 is impermeable, the downward movement of the drum head 58 stretches the air above the drum and produces a negative or "rarefied", pressure (relative to equilibrium pressure), above the batter head 58. Also, as the batter head 58 displaces downwardly the air below the batter head 58, that is, air inside the drum, is compressed to produce a positive pressure (relative to equilibrium). This compressed air inside the drum produces a pressure wave that radiates outward and away from the drum generating a sound. The amplitude of the compression wave, which give the volume or loudness of the generated sound, increases with increased magnitude of the compression of the air molecules.

The second head 59, e.g. the mesh head 60, is permeable. Thus, some of the air molecules that were originally inside the drum are driven by the positive pressure inside the drum through the mesh head 60 and into the space below the drum 1. The mesh head 60 deflects downward from the rest position to some extent. The magnitude of the downward deflection of the mesh head 60 is related to the positive pressure inside the drum, the amount of air resistance to the air passing through the mesh head, the mass of the mesh head, and the mesh head tension. The air below the drum is compressed by the movement of the mesh head 60 and the outflow of air from inside the drum to the space below the drum. The compression of the air below the drum is less than the compression of the air within the drum, so the sound created by the mesh head 60 is quieter than the sound produced by the batter head 58.

Referring now to FIG. 10, after the batter head 58 has been struck and deflected downwardly the batter head 58 rebounds. The combination of the positive pressure within the drum, the negative pressure above the drum and the tension in the membrane drives the batter head 58 upward. The batter head 58 overshoots the rest position and compresses the air above the drum head. This compression generates another compression wave that radiates outward and away from the drum generating another sound wave.

As the batter head 58 deflects upwardly, the air inside the drum, is stretched and produces a negative pressure region. Air molecules from below the drum are driven by the positive pressure below the drum through the mesh head 60 and into the inside of the drum 43. The mesh head 60 rebounds to a position above, to some extent, the rest position of the mesh head. The magnitude of the upward deflection of the mesh head 60 is related to the positive pressure below the drum, the negative pressure inside the drum, the amount of air resistance to the air passing through the mesh head, the mass of the mesh head, and the mesh head tension.

The resistance to air flow through the mesh head 60 affects the air linkage between the drum heads. The resistance to air flow through the mesh head 60 produces pressure effects inside the drum that are felt by the batter head 58 and change the way the batter head 58 responds to a drum strike—in comparison to a drum having no second head present.

The mesh head 60 dampens, to some extent, the air flow exiting and entering the bottom of the drum shell 7 making the batter drum 58 head behave as if the batter head 58 were working against a greater inertial mass of air that would be present if the drum depth was deeper. The resistance to free air flow out the bottom of the drum shell 7 is noticeable to the player in the attribute of stiffness or springiness of the performance head surface when struck. Without the mesh head 60 in place, the playing surface 56 would feel muddy under very low tension and over springy under higher tension. The presence of the mesh head 60 also extends the decay of the fundamental frequency of the batter head 58 to improve sound quality. That is, the resistance to air flow provided by the mesh head 60 interacts with the batter head 58 to produce better drum head responses and sound quality that would be present if a longer drum shell with an open bottom end were present. The result is a drum with a loud performance head having expected rebound properties with an unexpectedly shallow drum body 3.

Figure 11:
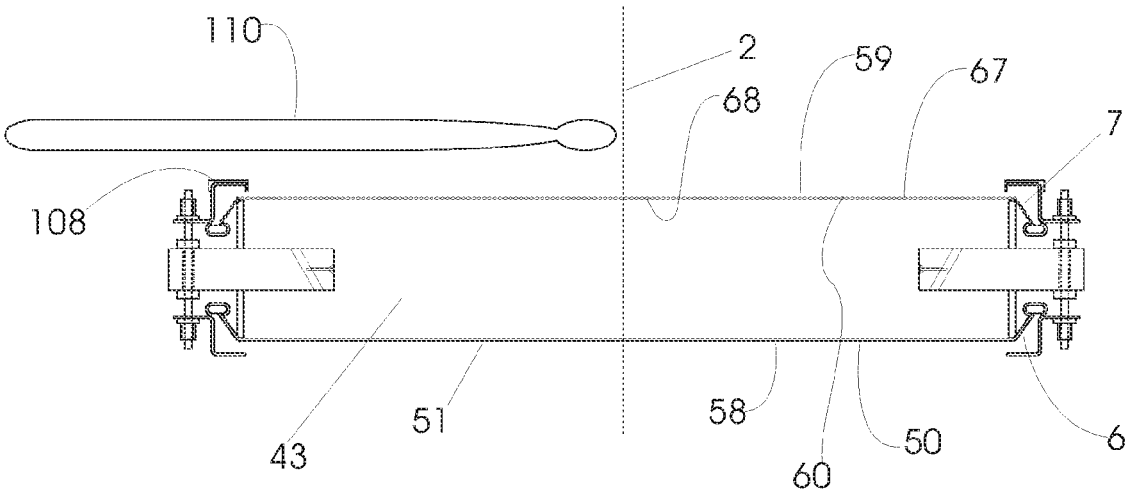
Figure 12:
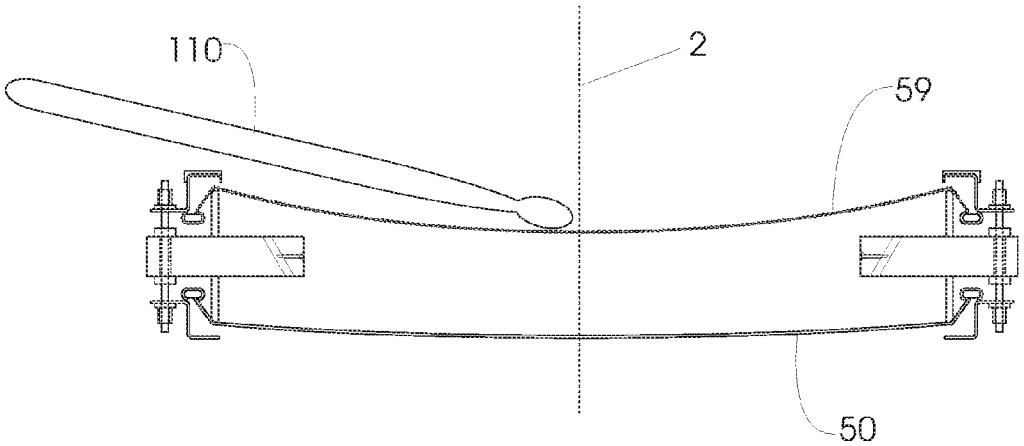
Figure 13:
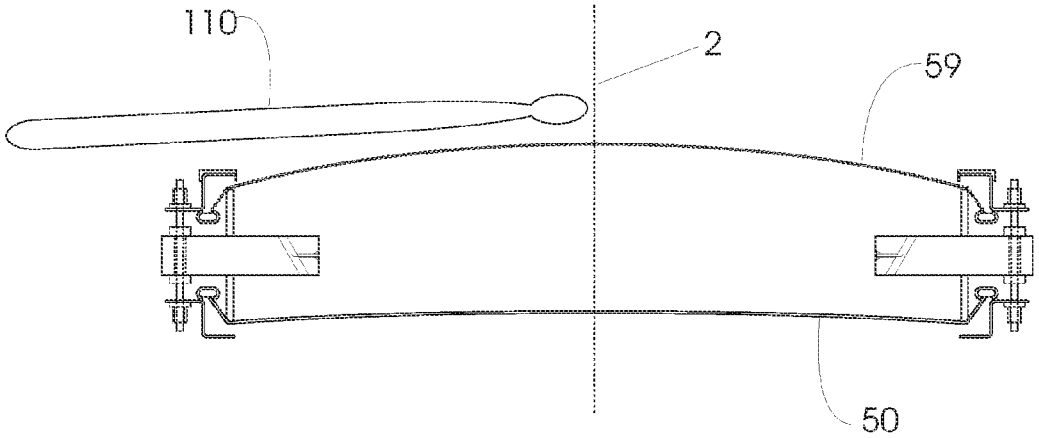

FIGS. 11-13 depict the response of the drum to being struck on the practice head 60. The drum 1 can be used in an unobtrusive mode, e.g. practice mode, by striking the practice head. To convert the drum from performance (loud) mode to practice (unobtrusive) mode the drum 1 may be removed from its holder (not shown), inverted, placed back in the holder with the practice head present to the drummer in the playing position, and secured in place. Alternatively, the drummer may move to the other side of the drum.

FIG. 11 show the drum 1 in the practice mode with the mesh head 60 on top and the batter head 58 on the bottom. The drum 1 is in a rest state prior to being struck.

Referring to FIG. 12, when the mesh drum head 60 is stuck it displaces downwardly. The downward movement of the mesh head 60 stretches the air above the drum and produces a negative pressure region above the mesh head 60. As the mesh head 60 deflects downwardly, the air inside the drum is compressed and produces positive pressure inside the drum. The mesh head 60 resists air flow, but does not block it entirely. Therefore, as the mesh head 60 deflects downward a small amount of air that was initial inside the drum passes from the positive pressure region of inside the drum through the mesh head 60 to the negative pressure region above the mesh head.

Thus, the region inside the drum 43 experiences a positive pressure region, but this region has a lower magnitude of positive pressure than if the practice head were impermeable. A small compression wave is formed that radiates outward and away from the drum generating a small sound wave amplitude. In this manner, the mesh head 60 produces a lower volume sound than the batter head 58 when struck in the same way.

Referring to FIG. 13, after the mesh head 60 has been struck and deflected downwardly the mesh head 60 rebounds. The combination of the positive pressure within the drum, the negative pressure above the drum, and the tension in the membrane drives the mesh head 60 upward. The mesh head 60 overshoots the rest position and compresses the air above the drum head. This compression generates another compression wave that radiates outward and away from the drum generating another sound wave.

As the mesh head 60 deflects upwardly, the air inside the drum, is stretched and produces a negative pressure region. Some of the air molecules from above the drum are driven by the positive pressure above the drum through the mesh head 60 and into the inside of the drum 43. Thus, the region above the mesh head experiences a positive pressure region, but this region has a lower magnitude of compressive pressure than if the practice head 59 were impermeable. A small compression wave is formed that radiates outward and away from the drum generating a small sound wave amplitude. In this manner, the mesh head 60 produces a lower volume sound than the batter head 58 when struck in the same way.

The mesh head 60 has low air linkage and so it does not move enough air to significantly impact, or significantly displace the batter head 58 through air linkage. However, energy from the displacement of the mesh head 60 also travels into the solid components of the drum body 3 (shell or shells and base, if present) and excites the natural frequencies of the batter head 58 through mechanical linkage. The batter head 58 perform the function of a sounding board, resonating with sympathetic vibration. The acoustic radiation from the sounding board are more perceivable than the small compression wave generated by the mesh head 60.

The air linkage between the drum heads increases the dampening of the movement of the mesh head 60 compared to a drum in which the batter head 58 is not present. The movement of the mesh head 60 is resisted, in part, by the positive pressure inside the drum when the mesh head 60 deflects downward and the negative pressure inside the drum when the mesh head 60 moves upward. Because the batter head 58 is impermeable it does not allow air to enter or escape the bottom of the drum body 6 to equalize the internal pressure. This additional dampening felt by the mesh head 60 can balance the undesirable overspringness that is typical of drums 1 with mesh heads 60 and open bottom ends 6.

Air linkage between the batter head 58 (e.g. the impermeable head) and the mesh head 60 (e.g. the permeable head) improves the dynamic performance of the drum head when struck, whether batter head 58 or mesh head 60 is struck. However, the magnitude of air linkage drops off as the distance between the drum heads 8, 9 is increased. A preferred distance 8, 9 from drum head to drum head is 2¾ inches or less. The preferred minimum distance between the drum heads is limited by the physical configuration required for sustaining tension on the drum heads. Referring to the embodiment shown in FIG. 1-4 that has an independent tension system, to tension the drum heads 50, 59 the shell 29, 36 must be longer than the collar 52, 63 so that the bead 54, 65 does not bottom out on the base 11. The collar of a typical drum head may be in the range of ⅕ inch to ⅗ inch. The thickness of the base 11 must also be accommodated. Taking these constraints in combination the preferred head to head drum length 8 is 2 inches or greater. Therefore, the preferred head to head distance 8 for the drum is in the range of 2 to 2¾ inches. Preferably, the length of the first shell 35 and the length of the second shell 37 are identical and are in the range of ¾ inch to 1¼ inch. Preferably, the base 11 has a thickness in the range of ⅜ inch to ¾ inch. Referring to the embodiment shown in FIG. 6 with the single drum shell, the preferred length 49 of the shell 44 is 1½ inch to 2¾ inch. More specifically, the preferred head to head distance 9 from one drum head to the other is the range of 1½ inch to 2¾ inch. The preferred ranges of drum length and shell lengths is applicable to a drum with a diameter within the range of 6 inches to 40 inches; more particularly, but not limited, to the discrete values of 6, 8, 10, 12, 14, 16, 18, 20, 22, 24, 26, 28, 30, 32, 34, 36, 38, or 40 inches. The preferred ranges of drum length and shell lengths is applicable to a drum with a diameter smaller than 6 inches.

Figure 17A:
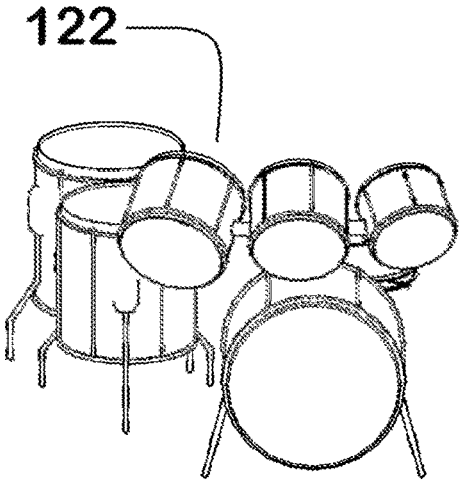
FIG. 17*a* is a view of a set of drums of the prior art configured in a deployed arrangement.
Figure 17B:
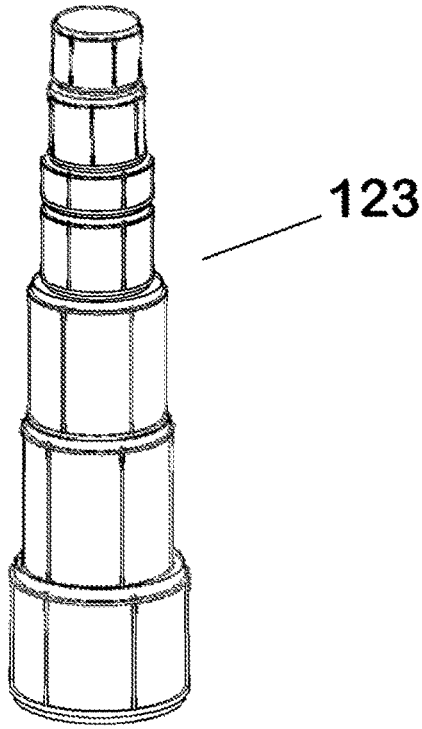
FIG. 17*b* is a view of a set of drums of the prior art configuration in a stacked arrangement.
Figure 18A:
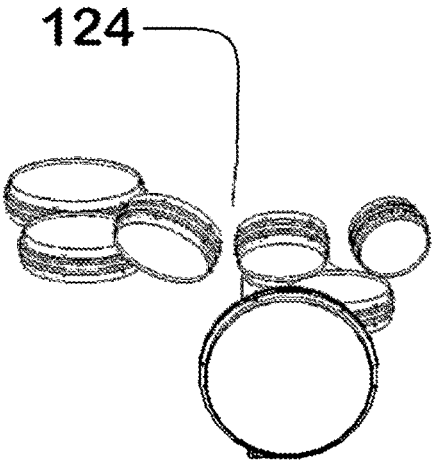
FIG. 18*a* is a view of a set of drums according to an exemplary embodiment of the present disclosure in a deployed arrangement.
Figure 18B:
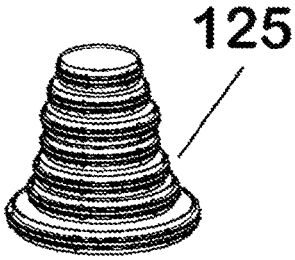
FIG. 18*b* is a view of a drum according to an exemplary embodiment of the present disclosure in a stacked arrangement.

FIGS. 17*a,b* depicts a typical drum set configuration comprising a set of common sized drums, in a typical use configuration 122 and a stacked configuration 123 for storage. FIGS. 18*a,b* shows a set of drums exemplary of the present invention in the same typical use configuration 124 and stacked configuration 125. The drums of the present invention are much smaller in length without sacrificing the standard diameter size of the playing surface. A set of drums can be large and difficult to store and transport. A set of drums with shallow drum shells, and thereby a shorter drum body 3, is smaller in size and easier to store and transport.

Figure 2:
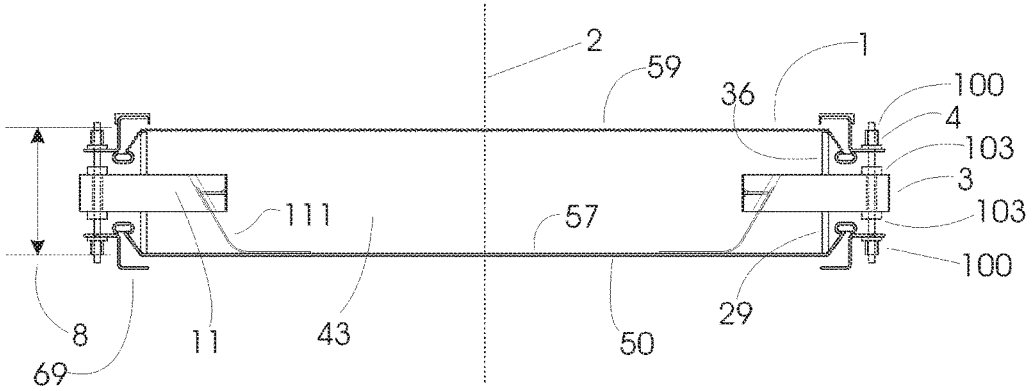
FIG. 2 is a cross-section side view of the drum in FIG. 1.
Figure 3:
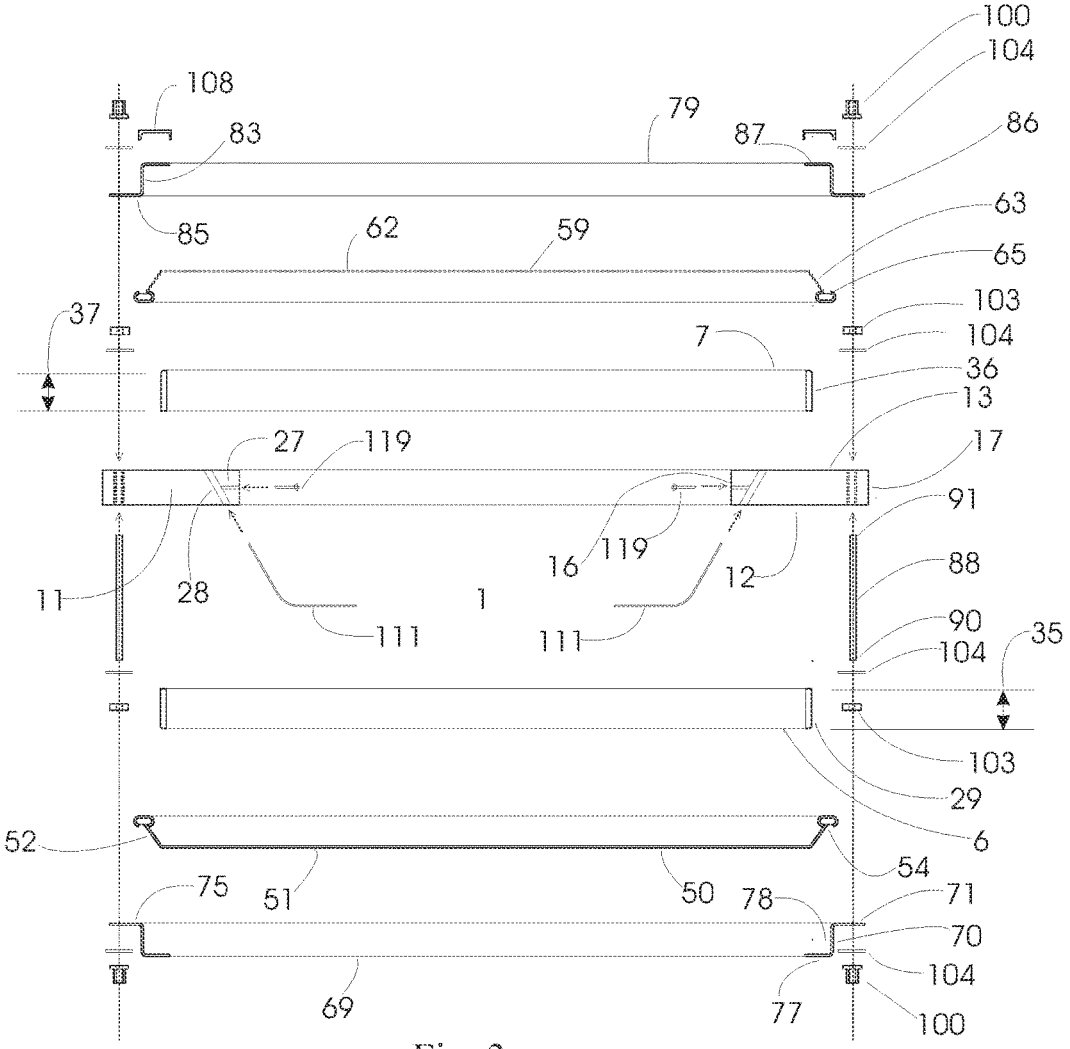
FIG. 3 is an exploded cross-section side view of the drum in FIG. 1.
Figure 4:
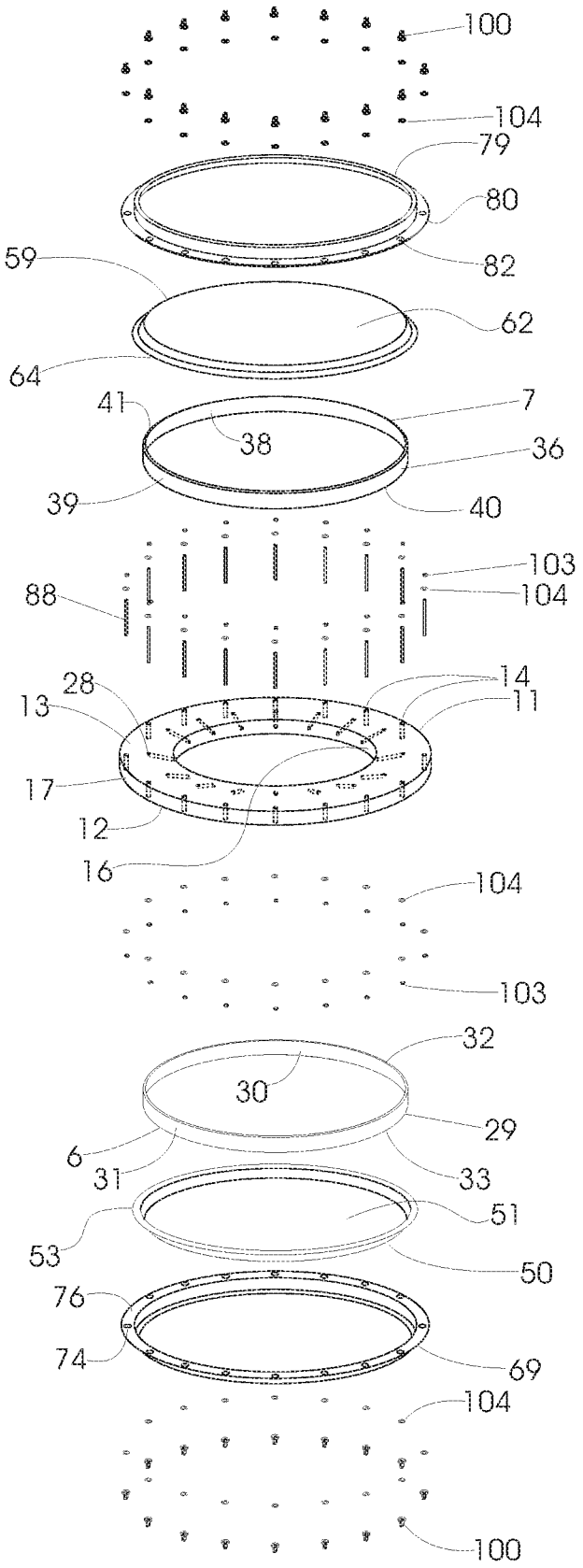
FIG. 4 is an exploded isometric view of the drum in FIG. 1.

As shown in FIGS. 2 and 3, the drum may have an optional snare wire 111. A snare wire 111 is commonly made of steel, rope, plastic, or rubber. A snare wire 111 can be straight, a chain, a coiled spring, or other shapes. Snare wires can be fitted with beads, marbles, sand, and other items to make enhanced sounds. A snare wire 111 is a wire that has been modified in some way to provide enhanced sound when it vibrates. The base 11 has a plurality of snare mounting holes 28 located on the first mount surface 12. The snare mounting holes 28 are arranged in a circular pattern that is inside the inner surface of the first shell 30. The holes 28 extend through the base 11 to the second mount surface 13. Alternately the snare mounting holes 28 may be blind holes. The snare mounting holes 28 may be slanted towards the central axis 2 of the drum. A snare securing hole 27 extends from the inner bore of the base 16 to each snare mounting hole 28.

The drum 1 may have one or more snare wires 111. Each snare wire 111 has a first end 112, a second end 113, and a mid-section 114 between the first end 112 and the second end 113. Each end of the snare wire 112, 113 is inserted into one of the snare mounting holes 28. A securing element 119, such as a threaded element (a set screw, for example) is advanced in the snare securing hole 27 until it binds upon the free end of the snare wire 112, 113.

Figure 15:
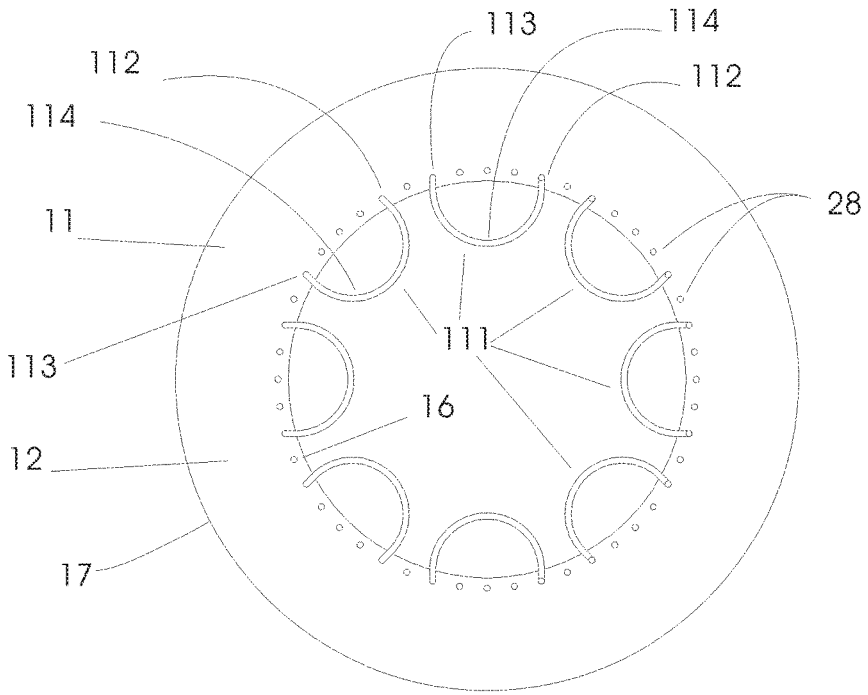
FIG. 15 is a top view of a drum according to an exemplary embodiment of the present disclosure.
Figure 16:
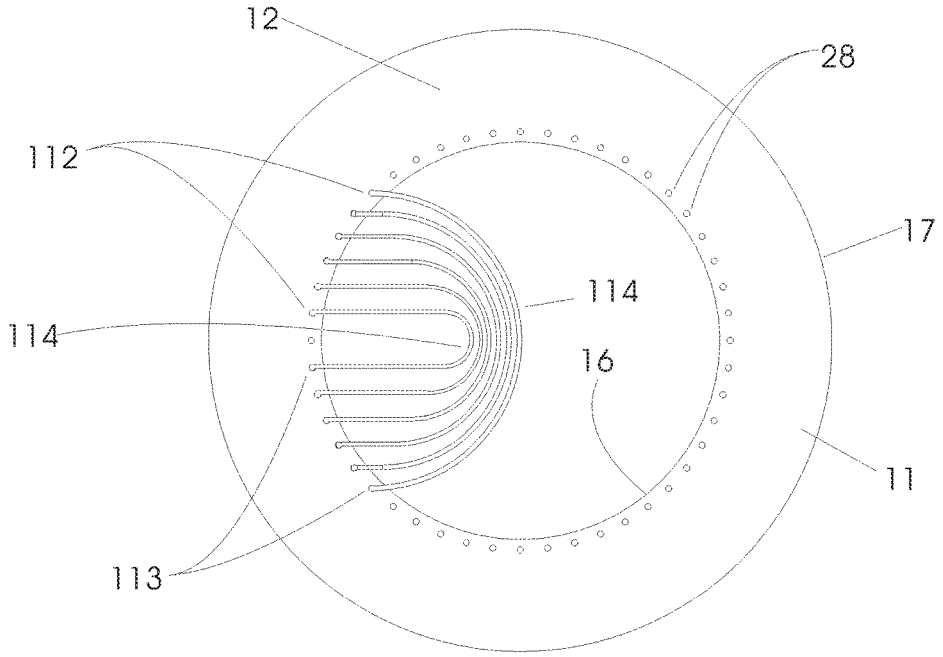
FIG. 16 is a top view of a drum according to an exemplary embodiment of the present disclosure.

FIG. 15 shows one exemplary configuration of the drum 1 having multiple snare wires 111. Each snare wire 111 is secured to the base 11 at each end of the snare wire 112, 113 with each mid-section 114 unsupported. The individual snare wires 111 are deployed side-by-side around the periphery of the base 11. FIG. 16 shows a second exemplary configuration of a drum 1 having multiple snare wires 111. Each snare wire 111 is secured to the base 11 at each end of the snare wire 112, 113 and each mid-section 114 is unsupported. The snare wires 111 are deployed in a nested pattern of strands. Other patterns are possible. The number of snare wires 111 and their locations can be configured to produce customized snare response to different sections of the drum so that striking the drum head at different positions produces customized sounds.

The drum 1 is configured so that when each end of the snare wire, or wires, 112, 113 is secured in a snare mounting hole 28 the midsection 114 of each wire 111 is pressed up against the underside of the drum head 57. Preferably the drum head 50 is a batter head 58. When the drum head 50 is struck with a drumming instrument 110, the drum head 50 vibrates and excites the one or more snare wires 111 to produce an enhanced sound.

One benefit of this snare system is that because the snare wires 111 are mounted to the drum base 11 there are no snare system elements mounted to the shells and so the shells are sandwiched shells free of adhesives, clamps, or other securing hardware that could introduce undesired audible effects.

In one aspect, the drum configurations present is a is a drum having a loud surface and a quiet surface opposing each other at either ends of an unexpected shallow drum body 6, 7. The loud side may produce a sound that is 20 dB a louder than the sound produced by the quiet side when struck in identical manner. The loud side may produce a sound that is 30 dBa louder than the sound produced by the quiet side when struck in identical manner. The loud side (e.g. first drum head 50) may produce a sound that is greater than 90 dBa and the quiet side (e.g. second drum head 59) may produce a sound that is less than 70 dBa when each side is struck with a heavy wood tip drum stick 110 with full force strikes. Volume performance data was measured with a 14-inch snare drum as measured by a digital sound level meter at a 6 feet distance in an open field peaked a reading of 80.5 dBa from the unobtrusive side, and 110.9 dBa from the loud side. This 30.4 dBa boast the unobtrusive side is perceived as being 12% of the volume in direct compartment to the usage of the loud side. Sounds were produced using heavy wood tip drum stick hitting the drum at above normal hard hits. The ambient noise level was measured to be 60 dBa.

Figure 14:
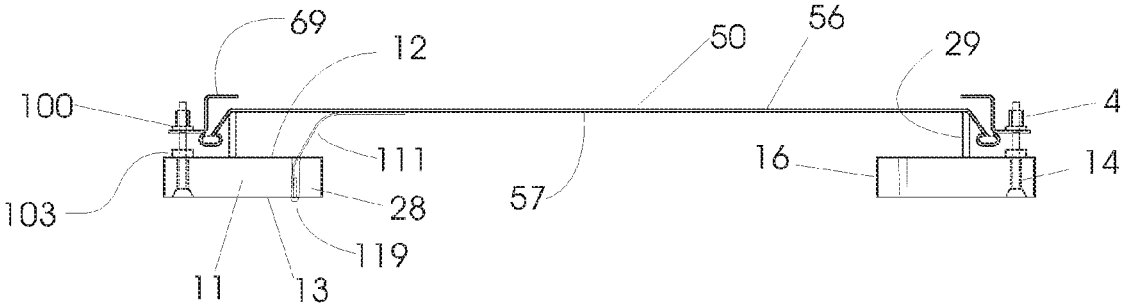
FIG. 14 is a side cross-section view of a drum according to an exemplary embodiment of the present disclosure.

FIG. 14 shows a second exemplary embodiment of the present drum 1 with attached snare wires 111. The snare mounting holes 28 are aligned with the drum axis 2. The snare mounting holes 28 are threaded internally. Each end of each snare wire 112, 113 is inserted down through one of the holes 28 from the first mount surface 12 and a screw 119 is advanced into the snare mount holes 28 from the second mount surface 13. Each screw 119 is advanced until it impinges on the end of the snare wire 112, 113 and secures the snare wire 111 to the base 11.

As demonstrated in this embodiment, the snare drum may not have the second drum head 59 or second shell 36. The drum may comprise the base 11, the first shell 29, the first drum head 50, a snare wire 111, and tension system 4 that secures the first drum head 50 to the base 11. Preferably the one head 50 is a batter head 58. The drum 1 is configured so that when each end of the snare wire, or wires 112, 113, is secured in a snare mounting hole 28 the midsection 114 of each wire is pressed up against the underside of the first drum head 57.

In another aspect, the present invention is a method for tuning a drum. A drum is obtained that comprises a base 11 having a first mount surface 12 and second mount surface 13, a first shell 29 disposed on the first mount surface 12, a first drum head 50 disposed over the first shell 29, a second shell 36 disposed on the second mount surface 13, a second drum head 59 disposed over the second shell 36, and a tensioning system 4 connecting the base 11 to the first drum head 50 and connecting the base 11 to the second drum head 59. The tensioning system 4 is configured to place the first drum head 50 under a first tension and place the second drum head 59 under a second tension. The first drum head 50 is tensioned to a first tension. The second drum head 59 is tensioned to a second tension. The tension in the first drum head 50 and the tension in the second drum head 59 may be adjusted independently. The tension in the first drum head 50 and the tension in the second drum head 59 may be tensioned sequentially. The drum 1 may be used by striking the first drum head 50 to produce a first drum sound and striking the second drum head 59 to produce a second drum sound.

In another aspect, the present invention is a method for using a drum. A drum 1 is obtained that comprises a drum body 3, a first drum head 50 disposed on a first end of the drum body 6, and a second head 59 disposed on a second end of the drum body 7. The drum 1 is configured to make a loud sound when the first drum head 50 is struck by a drumming instrument 110 and to make a quiet sound when the second drum head 59 is struck by the drumming instrument 110. The drum 1 is first secured into a holder so that the first drum head 50 is oriented into a playing position. The first drum head 50 is struck with a drumming instrument 110 to produce a loud sound. Then the drum 1 is removed from the holder. The drum is inverted and then the drum is secured into the holder in an inverted position so that the second drum head 59 is oriented into a playing position. Then the second drum head 59 is struck with the drumming instrument 110 to produce a quiet sound.

In another aspect, the present invention is a method for assembling a drum. A base 11 having a first mount surface 12 and second mount surface 13 is obtained. A first shell 29 is positioned on the first mount surface 12. A first drum head 50 is positioned over the first shell 29. A second shell 36 is positioned on the second mount surface 13. A second drum head 59 is positioned over the second shell 36. The first drum head 50 and the second drum head 59 are secured to the base 11 with a tensioning system 4. The tensioning system 4 is adjusted to tune the first drum head 50 and the second drum head 59.

In another aspect, the present invention is a method for assembling a drum. A base 11 having a mount surface 12 is obtained. A shell 29 is positioned on the mount surface 12. A drum head 50 is positioned over the shell. The drum head 50 is secured to the base 11 with a tensioning system 4. A snare wire 111 is obtained having a first end 112, a second end 113, and a midsection 114 between the first end 112 and the second end 113. The snare wire 111 is secured to the base 11 such that the first end 112 and the second end 113 are secured to the base 11 and the midsection 114 is disposed against an underneath surface of the drum head 57.

Although the present invention has been described in considerable detail regarding certain preferred versions thereof, other versions are possible. Therefore, the spirit and scope of the appended claims should not be limited to the description of the preferred versions contained therein.

We claim:

1. A drum comprising:

a drum body having a first edge and a second edge at opposite ends of the drum body, a first drum head disposed against the first edge, a second drum head disposed against the second edge;

wherein the first drum head has high air resistance and the second drum head has low air resistance;

wherein the support system comprises a drum shell, the drum further comprising a tensioning system, the tension system comprising:

a first hoop disposed over a peripheral edge of the first drum head, and a second hoop disposed over a peripheral edge of the second drum head;

wherein the tensioning system is configured to secure the first drum head to the first edge and to place the first drumhead under a first tension, and to secure the second drum head to the second edge and to place the second drum head under a second tension, and wherein the tensioning system connects the first hoop to the second hoop.

2. The drum of claim 1, wherein the first drum head is impermeable to airflow and the second drum head is permeable to airflow.

3. The drum of claim 1, wherein the first drum head is a batter drum head and the second drum head is a mesh drum head.

4. The drum of claim 1, wherein the drum body comprises:

a base having a first mount surface and an opposed second mount surface, a first drum shell disposed on the first mount surface, and a second drum shell disposed on the second mount surface, wherein the first edge is on the first shell and the second edge is on the second shell, and wherein the drum further comprises tensioning system, the tensioning system configured to secure the first drum head to the first edge and to place the first drum head under a first tension, and to secure the second drum head to the second edge and to place the second drum head under a second tension, and wherein the tensioning system is configured to allow for the first tension and the second tension to be adjusted independently.

5. A drum comprising:

a drum body having a first edge and a second edge at opposite ends of the support system, a first drum head disposed against the first edge, a second drum head disposed against the second edge, wherein the drum is configured to make a loud sound when the first drum head is struck by a drumming instrument and to make a quiet sound when the second drum head is struck by the drumming instrument, and further comprising a tensioning system, the tensioning system configured to secure the first drum head to the first edge and to place the first drum head under a first tension, and to secure the second drum head to the second edge and to place the second drum head under a second tension, and wherein the tensioning system is configured to allow for the first tension and the second tension to be adjusted independently.

6. The drum of claim 5, wherein when the drumming instrument is a wooden drum stick and the first drum head and second drum head are struck at full force the difference between the volume of the loud sound and the volume of the quiet sound is at least 20 dBa, or the volume of the loud sound is at least 90 dBa and the volume of the quiet sound is no more than 70 dBa.

7. The drum of claim 5, wherein the first drum head is a batter drum head and the second drum head is a mesh drum head.

8. The drum of claim 6, wherein the first drum head is disposed at a distance from the second drum head in the range of 2 to 2¾ inches.

9. A drum comprising:

a base having a first mount surface and an opposed second mount surface, a first shell disposed on the first mount surface, a first drum head disposed over the first shell, a second shell disposed on the second mount surface, a second drum head disposed over the second shell, a tensioning system connecting the base to the first drum head and connecting the base to the second drum head;

wherein the tensioning system places the first drum head under a first tension and place the second drum head under a second tension, the drum further comprising a tensioning system:

a first plurality of threaded rods secured to the base and extend from the first surface, a second plurality of threaded rods secured to the base and extended from the second surface, a first hoop disposed over a peripheral edge of the first drum head and engaging the first plurality of threaded rods;

a second hoop disposed over a peripheral edge of the second drum head and engaging the second plurality of threaded rods, and a plurality of threaded lugs;

wherein at least one of the threaded lugs is advanced on at least one of the first plurality of threaded posts to draw the first hoop towards the base and stretch the first drum head over the first shell to place the first drum head under a first tension, and wherein at least one of the threaded lugs is advanced on at least one of the second plurality of threaded posts to draw the second hoop towards the base and stretch the second drum head over the second shell to place the second drum head under a second tension.

10. The drum of claim 9, wherein the tensioning system is configured to allow for the first tension and the second tension to be adjusted independently.

11. The drum of claim 10, wherein the first drum head is a batter drum head and the second drum head is a mesh drum head.

12. The drum of claim 9, wherein the tensioning system comprises:

a first hoop disposed over a peripheral edge of the first drum head, and a second hoop disposed over a peripheral edge of the second drum head;

wherein the tensioning system connects the first hoop and the second hoop to the base.

13. The drum of claim 9, wherein the length of the first shell is within the range of ¾ to 1¼ inches, and the length of the second shell is in the range of ¾ to 1¼ inches.

14. The drum of claim 9 wherein the first shell is a sandwiched shell, the second shell is a sandwiched shell, or both.

15. The drum of claim 14, wherein the tensioning system is configured to capture the first drum shell between the first drum head and the base and to secure the first drum shell to the first mount surface, and wherein the tensioning system is configured to capture the second drum shell between the second drum head and the base and to secure the second drum shell to the second mount surface.

16. The drum of claim 9, wherein the first drum head is disposed at a distance from the second drum head in the range of 2 to 2¾ inches.

17. A drum comprising:

a base having a mount surface, a shell disposed on the mount surface, a drum head disposed over the shell, the drum head having an underneath surface, and one or more snare wires secured to the base;

wherein a portion of the one or more snare wires is disposed against the underneath surface, wherein the one or more snare wire comprises:

one or more first ends, one or more second ends, and one or more midsection between the one or more first ends and the one or more second ends; and wherein the one or more first ends and the one or more second ends are secured to the base and the one or more midsections are disposed against the underneath surface.

18. The drum of claim 17, wherein the mount surface is a first mount surface, the shell is a first shell, and the drum head is a first drum head;

wherein the drum further comprises:

a second shell, and a second drum head;

wherein the base comprises a second mount surface opposed to the first mount surface, the second shell is disposed on the second mount surface, and the second drum head is disposed over the second shell; and wherein the one or more snare wires are enclosed between the first drum head and the second drum head, and wherein the first drum head is a batter drum head and the second drum head is a mesh drum head.

19. The drum of claim 18, wherein the first drum head is disposed at a distance from the second drum head in the range of 2 to 2¾ inches.

* * * * *